United States Patent [19]

Hotta et al.

[11] 4,370,545

[45] Jan. 25, 1983

[54] COOKING APPARATUS

[75] Inventors: Kouichi Hotta, Yachio; Yukichi Yazawa, Kashiwa, Japan; Osami Tatsukawa, Matsudo, all of Japan

[73] Assignee: Hitachi Heating Appliances Co., Ltd., Kashiwa, Japan

[21] Appl. No.: 201,765

[22] Filed: Oct. 29, 1980

[30] Foreign Application Priority Data

Oct. 30, 1979 [JP] Japan ..... 54-140155

[51] Int. Cl.[3] ..... H05B 1/02

[52] U.S. Cl. ..... 219/491; 200/46; 307/115; 219/10.55 B

[58] Field of Search ..... 307/115; 200/46; 235/435, 442; 219/491, 492, 493, 10.55 B

[56] References Cited

U.S. PATENT DOCUMENTS

| | | | |
|---|---|---|---|
| 2,662,944 | 12/1953 | Carney et al. | 200/46 |
| 3,031,558 | 4/1962 | Euler | 200/46 X |
| 3,227,818 | 1/1966 | Belaieff | 200/46 |
| 4,131,786 | 12/1978 | Cooper | 219/10.55 BB |
| 4,297,568 | 10/1981 | Okatsuka | 200/46 |

*Primary Examiner*—A. T. Grimley
*Assistant Examiner*—Morris Ginsburg
*Attorney, Agent, or Firm*—Antonelli, Terry and Wands

[57] ABSTRACT

A cooking apparatus provided with a card type switch actuator including a card holder having at least an openable cover member and a bottom wall disposed in opposition to the cover member in its closed state, a plurality of push-button switches mounted on the bottom wall of the card holder, a plurality of cards of a substantially same size prepared for various control purposes, respectively, and a chamber provided in the card holder for accommodating a selected one of the cards at a predetermined position. Each of the push-button switches has a push-button head projecting in the chamber from the bottom wall, and each of the cards is provided with through-holes of a size slightly greater than that of the push-button head at locations corresponding to the positions of those push-button switches which are not to be actuated depending on the control purpose assigned to the card. When a selected one of the cards is disposed within the chamber of the card holder and the cover member is closed, the selected card is urged toward the bottom wall of the card holder, whereby those push-button switches located at the positions corresponding to those of the through-holes formed in the selected card remain unactuated, while the other push-button switches are actuated by the selected card under pressure exerted thereby on the push-button heads of the other push-button switches.

4 Claims, 8 Drawing Figures

COOKING APPARATUS

The present invention relates generally to a cooking apparatus. More particularly, the invention concerns a cooking apparatus provided with a switch actuator system of the card type which allows one or more selected ones among a plurality of switches to be actuated simultaneously for selecting heating functions, by using a cooking card.

For example, in a cooking apparatus incorporating an electric heater and/or a microwave energy generator, it is known that the on-off operations of such an electric heater and/or a microwave energy generator is sequentially controlled with the aid of a plurality of timers and a plurality of switches. In the present state, all of these switches are adapted to be manually turned on and off. In consideration of the fact that the selection of switches varies depending on the types of items to be cooked or cooking processes to be effected, the manual on-off operation of the switches means a troublesome procedure for the user, involving possibly erroneous actuation of false switches, negligence of switch actuation or the like shortcomings.

An object of the present invention is therefore to eliminate the drawbacks described above and provide a cooking apparatus which is provided with a switch actuator apparatus which is capable of simultaneously actuating all the switches to be selected while excluding positively any erroneous switch actuation, and in which some of heating processes which do not vary depending on the operator's choice or depending on the selection of the item to be cooked can be automatically set by using a selected cooking card, and the variable factors such as a heating duration and/or a cooking temperature which undergo variations depending on the composition of the item to be cooked, water content, desired taste or the like can be manually set at proper values based on the indication on the selected card, so that the convenience in use is improved.

According to an aspect of the invention, there is provided a cooking apparatus provided with a card type switch actuator apparatus which comprises a card holder including at least a cover member openably supported and a bottom wall disposed in opposition to the cover member in its closed state, a plurality of push-button switches mounted on the bottom wall of the card holder, a plurality of cooking cards of a substantially same size prepared respectively corresponding to various cooking items, and a manually operated actuating knob provided near the card holder. The card holder is provided with a chamber for accommodating a selected one of the cooking cards at a predetermined position. Each of the push-button switches has a push-button head projecting in the chamber from the bottom wall of the card holder. Each of the cooking cards is provided with through-holes of a size slightly greater than that of the push-button head at locations corresponding to the positions of those of the push-button switches which are not to be actuated depending on the control purpose assigned to the card. When a selected one of the cooking cards is disposed within the chamber of the card holder and the cover member is closed, the selected cooking card is urged toward the bottom wall of the card holder, whereby those push-button switches located at the positions corresponding to those of the through-holes formed in the selected cooking card remain unactuated, while the other push-button switches are actuated by the selected cooking card under pressure exerted by the selected cooking card on the push-button heads of the other push-button switches.

The novel features believed characteristic of this invention are set forth in the appended claims. The invention itself, however, as well as other objects, features and advantages thereof may best be understood by reference to the following detailed description when read in conjunction with the accompanying drawings, in which:

Now, an exemplary embodiment of the invention will be described by referring to the drawings in which same reference characters denote same or equivalent elements.

Figure 1:
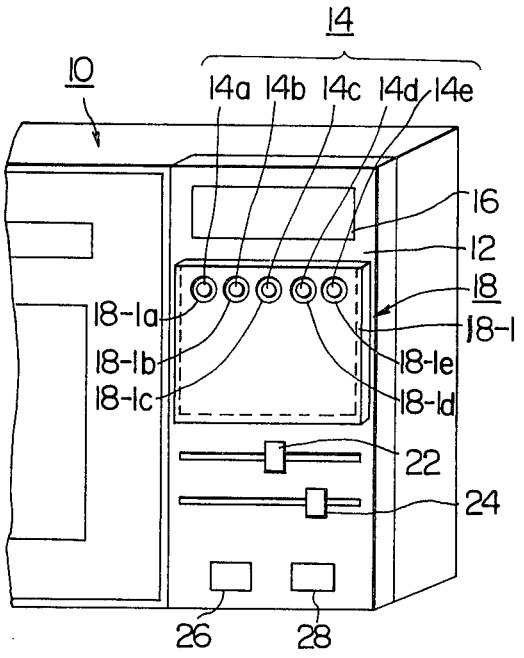
FIG. 1 shows, in a partial perspective view, a portion of a manipulation panel incorporating a card type switch actuator apparatus according to an embodiment of the invention in a state in which no cooking program card is inserted in a card holder.
Figure 5:
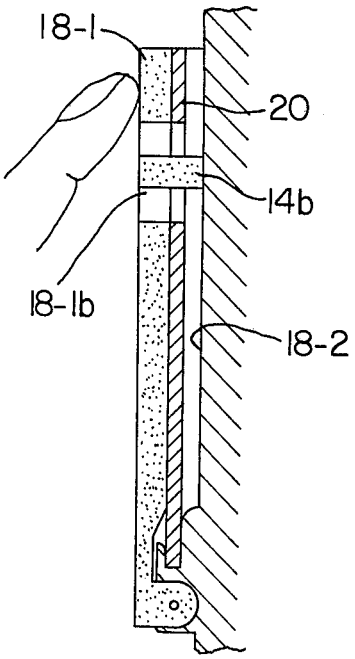
FIG. 5 is a fragmental sectional view of FIG. 3 and illustrates a portion of the card holder at which an associated switch is unactuated.
Figure 6:
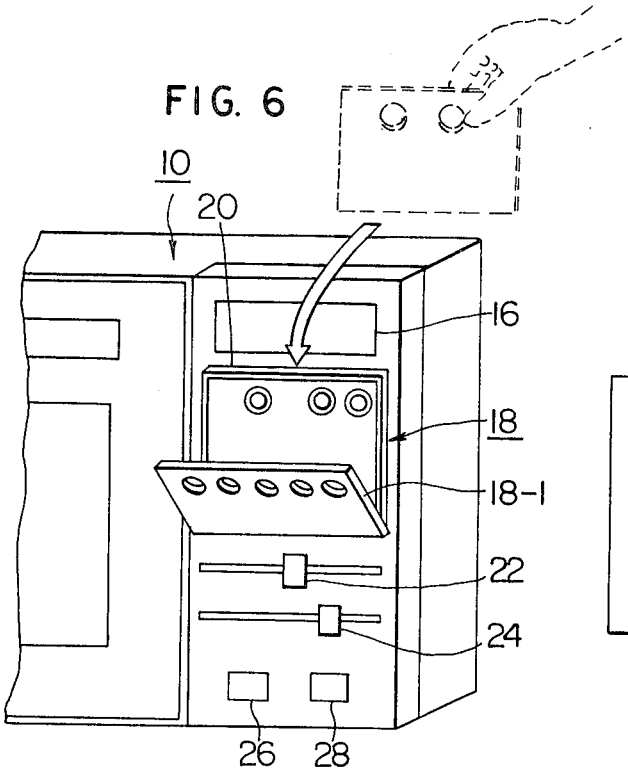
FIG. 6 is a view similar to FIG. 3 except that a cover of the card holder is shown in the open state.
Figure 8:
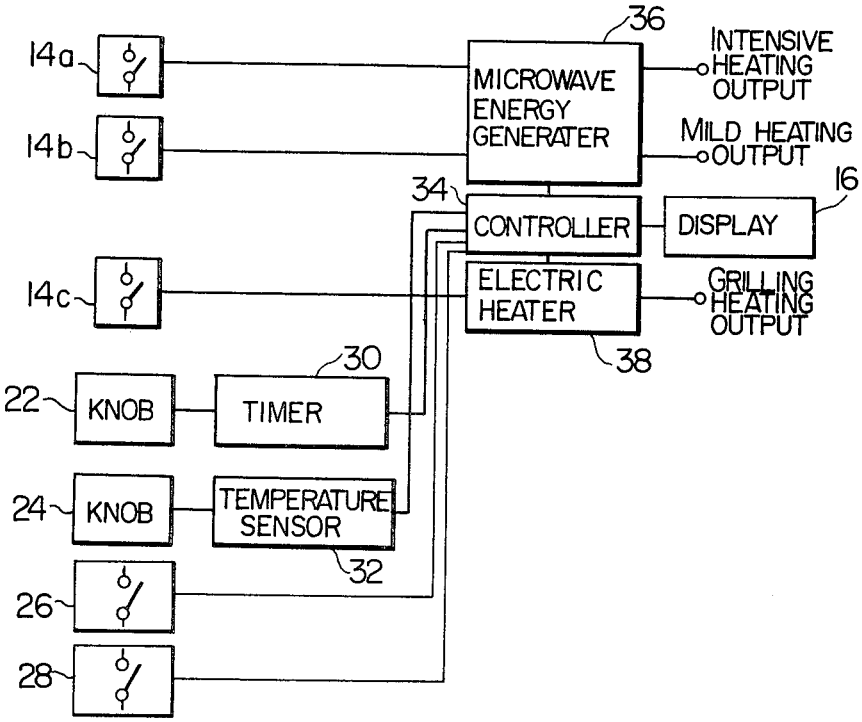
FIG. 8 is a block diagram to illustrate heating functions of the cooking apparatus shown in FIGS. 1 and 3.

FIG. 1 shows a cooking apparatus which is generally denoted by reference numeral 10 and which may comprise an oven for cooking items of food under heating by means of an electric heater, a steam boiler and/or a microwave energy generator (not shown). The cooking apparatus 10 has a manipulation or control panel denoted by reference numeral 12. There is provided on the manipulating or control panel 12 a switch array designated generally by reference numeral 14 and including a plurality of push-button switches. These push-button switches may be of the type which has no self-holding function. In the case of the illustrated embodiment, by way of example it is assumed that only five push-button switches 14*a*, 14*b*, 14*c*, 14*d* and 14*e* are provided for effecting a variety of heating operation modes which are different from one another. For example, the push-button switches 14*a* and 14*b* are connected to a microwave energy generator circuit as shown in FIG. 8 for causing it to be operated with high and low output energy levels thereby to effect an intensive heating mode and a mild or gentle heating mode, respectively, while the push-button switch 14*c* is connected to an electric heater circuit for effecting a grilling heating mode. The switches 14*d* and 14*e* are connected to a steam boiler actuating circuit (not shown) and another electric heater circuit (not shown) so as to effect a steam warming mode and a boiling mode, respectively. If the push-button switches 14*a* and 14*c* are depressed for example, such a heating or cooking process may be selected according to which the microwave energy generator is first turned on so that the item of food being cocked is heated to the core or interior thereof under the action of the high level microwave energy and then the electric heater for charring the surface of the item is turned on. The selected cooking process or mode can be displayed on a display device 16. Such a heating process may be performed with the aid of switches 26 and 28 and a control circuit 45 (FIG. 8) as will be described later. Reference numeral 18 denotes a card holder for accommodating therein a cooking program card which will hereinafter be described in detail. The button heads of the push-button switches 14*a*, 14*b*, 14*c*, 14*d* and 14*e* project in the holder chamber of the card holder 18 from the bottom wall 18-2 (FIGS. 4 and 5) to which a cover member 18-1 described later is opposite. The card holder 18 includes the cover member 18-1 pivotally mounted so as to be closed and opened in an arbitrary manner. The cover member 18-1 is formed with through-holes 18-1*a*, 18-1*b*, 18-1*c*, 18-1*d* and 18-1*e* of a size which allows a finger of the operator to be inserted therethrough for accessing to the associated switch. The through-holes 18-1*a*, . . . , 18-1*e* are in alignment with the heads of the push-button switches 14*a*, . . . , 14*e*, respectively, so that given one or more of these switches can be selectively operated externally of the cover member 18-1 by the finger of operator through the associated through-holes, when no cooking program card (hereinafter referred to also as the cooking card) is present within the card holder 18. Alternatively, the cover member 18-1 may be formed with a window (not shown) which is wide enough to include all these through-holes 18-1*a*, . . . , 18-1*e*. The cover member 18-1 may be pivotally mounted by means of hinges provided at any one edge, for example at the lower edge, thereof so that it can be opened outwardly, as is illustrated in FIG. 6. FIG. 6 provides a better understanding of the process through which a selected cooking card is inserted into the card holder. Further, the cover member 18-1 may preferably be made of a transparent material or alternatively formed with a window (not shown) so that descriptions or marks on the cooking card inserted in the card holder 18 can be read externally from the cover member 18-1 through this transparent cover or through the window respectively, when the card is accommodated within the card holder 18.

Figure 2:
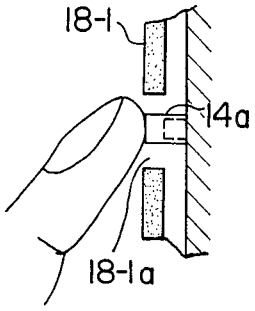
FIG. 2 is a fragmental sectional view of the card holder shown in FIG. 1 and illustrates a manner in which a heating mode is set by manually actuating a switch.

FIG. 2 illustrates the case in which no cooking card is present within the card holder 18 and a selected one of the switches, for example the switch 14*a*, is going to be pushed by a finger of the operator through the corresponding hole 18-1*a* of the cover member 18-1.

Figure 3:
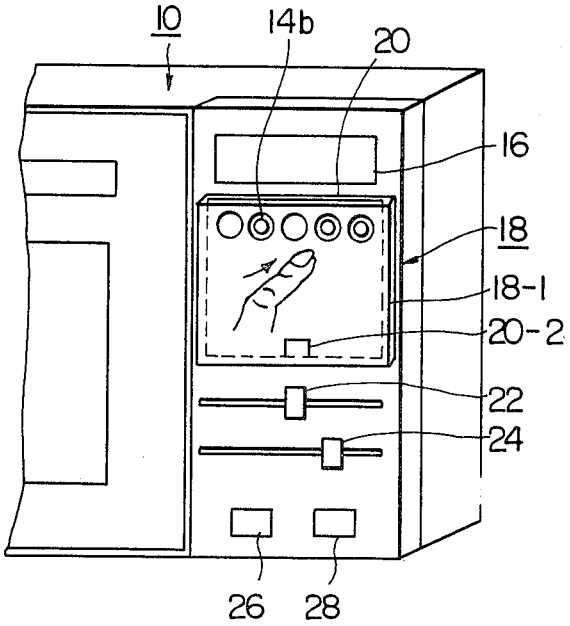
FIG. 3 is a view similar to FIG. 1 but shows the cooking apparatus in the state in which a selected cooking card is inserted in a card holder.
Figure 4:
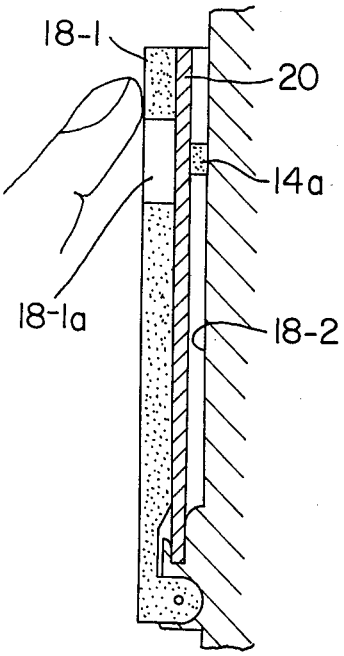
FIG. 4 is a fragmental sectional view of FIG. 3 and illustrates a portion of the card holder in the state in which one of switches is actuated under pressure exerted by the inserted card.
Figure 7:
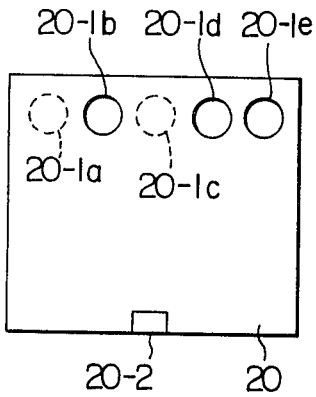
FIG. 7 shows in a plan view a switch actuator card according to an exemplary embodiment of the invention.

The cooking card which is generally denoted by a reference numeral 20 has one or more through-holes 20-1*a* to 20-1*e* formed and arrayed in accordance with the type of the cooking commanded by the cooking card, as is illustrated in FIG. 7. The size of the through-holes 20-1*a* to 20-1*e* formed in the cooking card is substantially the same as that of the through-holes formed in the cover member 18-1. In the case of the cooking card 20 illustrated in FIG. 7, there are formed the through-holes 20-1*b*, 20-1*d* and 20-1*e* corresponding to the switches 14*b*, 14*d* and 14*e*, respectively. Accordingly, when this card is placed in the card holder 18 by opening the cover member 18-1, the button heads of the switches 14*b*, 14*d* and 14*e* are allowed to extend through the associated holes 20-1*b*, 20-1*d* and 20-1*e* and thus cannot be actuated by the inserted card when the cover member 18-1 is closed. On the other hand, there is formed in the card 20 no through-holes at locations 20-1*a* and 20-1*c* corresponding to the switches 14*a* and 14*c*. Accordingly, when the cover member 18-1 is depressed by a finger of the operator as shown in FIG. 3 after the cooking card has been placed in the card holder 18 and the cover member has been closed, the cooking card 20 is pressed against the switch array under the pressure exerted by the cover member 18-1, resulting in that the switches 14*a* and 14*c* corresponding to the locations 20-1*a* and 20-1*c* where no through-holes are present will be depressed to be actuated by the card, as is illustrated in FIG. 4. However, the other switches 14*b*, 14*d* and 14*e* can extend as shown in FIG. 5 through the associated through-holes 20-1*b*, 20-1*d* and 20-1*e*, respectively, and thus remain unactuated. When the cover member is released from the depression by the operator, the cover member may be moved away from the bottom wall 18-2 to its normal closed position due to the spring force of the switches 14*a* and 14*c* which switches were depressed when the operator closed the cover member. In this case, only the intensive heating mode by the microwave energy generator and the grilling heating mode by the electric heater are selected. Accordingly, the item of food is at first heated, for example, to the inner core under the action of microwave energy with the intensive heating mode and subsequently charred with the grilling heating mode by the electric heater, as described hereinbefore. The cooking process or mode as selected is displayed through a control circuit 34 (FIG. 8), on the display device 16.

Referring to FIGS. 1, 3 and 6, there are disposed on the control panel 12 below the card holder 18 knobs 22 and 24 which serve for setting the heating duration or period and the heating or cooking temperature, respectively. Through manipulation of these knobs 22 and 24, the heating period and the heating or cooking temperature (i.e. the temperature at which the heating or cooking operation is to take place) are adjustably set by a timer 30 and a temperature sensor 32, for example, in a well known manner. The output signals from the timer 30 and the sensor 32 are supplied to the controller 34 for controlling the turn-on and the turn-off of the microwave energy generator 36 and the electric heater 38 in a conventional manner. For example, when a heating duration is set at the timer through manipulation of the knob 22 when the switches 14*a* and 14*c* are selected to be actuated, the microwave energy generator 36 is at first turned on by the controller 34 for effecting the intensive heating mode during the period set at the timer 30. After lapse of the set period, the microwave energy generator 36 is turned off by the controller 34, while the electric heater 38 is simultaneously turned on to effect the grilling heating mode for charring the surface of the food. In response to the output signal from a char state detector (not shown), the controller 34 turns off the electric heater 38. On the other hand, when the switches 14*a* and 14*b* are selected and a heating temperature is set through a corresponding manipulation of the knob 24, the controller turns on the microwave energy generator 36 for effecting the intensive heating mode until the set temperature has been attained, whereupon the microwave energy generator 36 is changed over to the mild or gentle heating mode in which the heating operation is effected so as to maintain the food at the set temperature. It is self-explanatory that the knobs 22 and 24 as well as the associated heating modes described above are only for the purpose of illustration. There may of course be provided a variety of mode setting knobs in accordance with the cooking programs intended to be executed.

The surface of the cooking card 20 may be provided with indications at a location 20-2 (refer to FIG. 7) for indicating the position of the knob 22 for setting the heating period and/or the position of the knob 24 for setting the heating temperature in the case of an oven heating mode, whereby the knobs 22 and/or 24 can be selectively displaced to the indicated position or positions. For example, when the length of the heating period is indicated with tolerance or margin in such a manner that the heating period is from 10 minutes to 15 minutes, the associated knob 22 is set at a selected position in the range corresponding to the range of the indicated heating period. Then, the length of the heating period selected by the knob 22 is displayed on the display device 16. By observing the displayed heating period, it is further possible to adjust the set position of the knob in consideration of material to be cooked, water content, desired taste and the like factors thereby to set the optimum heating period.

A heating start switch 26 for initiating the heating operation is provided at a lowermost location, for example, of the control panel 12. By manually pushing this switch 26, the heating cycle is initiated and carried out in accordance with the heating program set by the card 20 or by manually and selectively actuating the push-button switch or switches of the switch array 14. Assume now that the switches **14*a* and 14*c* are despressed by the cooking card 20 or by a finger of the operator, the microwave energy generator 36 and the electric heater 38 are enabled. Even if the switches 14*a* and 14*c* are relieved after the microwave energy generator 36 and the electric heater 38 have once been enabled, the microwave energy generator 36 and the electric heater 38 will be kept enabled. Then, when the switch 26 is depressed, the controller 34 causes the microwave energy generator 36 to produce its intensive heating output to heat the interior of the item of food and thereafter causes the electric heater 38 to produce its grilling heating output, as described above. Reference numeral 28 denotes a cancel switch. The cooking program as set by actuating selected ones of the switches can be cancelled by pushing this switch 28. The provision of such cancel switch is preferable for cancelling the cooking program when error is found in the displayed program before initiating the heating operation by the depression of the switch 26**.

As will be appreciated from the foregoing description, there has been provided according to an aspect of the invention a cooking apparatus in which some of heating processes which do not vary in accordance with the operator's choice or the selection of the item to be cooked can be automatically set by a selected cooking card, while the variable factors such as a heating duration and/or a cooking temperature which undergo variations depending on the composition of the item to be cooked, water content, desired taste or the like can be manually set at proper values under indication by the selected cooking card. Thus, the cooking or heating mode as desired can be set in a facilitated manner with the heating period and the cooking temperature being easily modified to desired values. It goes without saying that the cooking apparatus according to the invention can be manually operated without the aid of the cooking card, as shown in FIG. 1.

We claim:

1. A cooking apparatus comprising: heating means; a plurality of cooking program cards; a card holder for accommodating therein a selected one of said cooking program cards; a cover member mounted on said card holder for movement between open and closed positions; a group of switches disposed within said card holder for selectively determining heating modes of said heating means of said cooking apparatus; and a plurality of through-holes formed in said cover at locations respectively corresponding to said switches so that said switches can be selectively accessed through the corresponding through-holes, each cooking program card being formed with through-holes of a size to permit said switches to extend therethrough at locations corresponding to the positions of those of said switches which are not to be actuated when the cooking program card placed in said card holder and is pressed against said group of the switches, while those of said switches located at positions corresponding to the portions of said cooking program card where said through-holes are not formed are caused to be actuated under the pressure exerted by said cooking program card upon closing of said cover member, each of said cooking program cards having a surface on which required information concerning the cooking process associated with said cooking program card is inscribed, said cover member having a portion enabling said information inscribed on the cooking program card inserted in said card holder to be viewed externally through said cover member, and at least a knob coupled to said heating means for adjustably setting a cooking temperature, said knob being adapted to be manually set in accordance with the information inscribed on the surface of the selected cooking program card inserted in said card holder.

2. A cooking apparatus comprising heating means for heating an item to be heated in a selected one of a plurality of heating modes, a plurality of cooking cards, each cooking card corresponding to at least one different item to be heated, a card holder for accommodating a selected one of said cooking cards, a plurality of switches coupled to said heating means for selecting the heating mode in accordance with the actuation thereof, said switches being arranged in the region of said card holder, a cover having at least a transparent portion, said cover being mounted for movement with respect to said card holder between at least an open and closed position, said cover in the open position enabling insertion of a selected one of said cooking cards into said card holder, said cover being provided with a plurality of through holes corresponding respectively to said plurality of switches and arranged opposite to said switches so that when said cover is in the closed position, said switches are accessible through said through holes in said cover; said cooking cards being provided with at least one through hole arranged so that when a respective cooking card is inserted and accommodated in said card holder and said cover is pressed to the closed position to press the cooking card against said switches, the at least one through hole in said cooking card is disposed opposite to a respective one of said switches so that such switch is not actuated whereas the portion of said cooking card without through holes disposed opposite to other respective ones of said switches presses against and actuates said other respective ones of said switches for selection of the corresponding heating mode, each of said cooking cards being provided with indicia on the surface thereof indicating at least one type of information of a heating period of time and a heating temperature, said indicia being viewable through said transparent portion of said cover when said cooking card is accommodated in said card holder, and at least one manipulation knob coupled to said heating means for manually setting the at least one of heating period and heating temperature in accordance with said indicia on said cooking card accommodated in said card holder.

3. A cooking apparatus according to claim 2, wherein said cover is pivotally mounted along an edge portion of said card holder, said card holer including a wall portion having said switches arranged thereon, said cover in the closed position being disposed oppositely to said wall portion of said card holder, said through holes of said cover being of a sufficient size to enable access to said switches through said cover, said through holes of a respective one of said cooking cards being of a sufficient size to permit said switches to extend therethrough when said cooking card is accommodated in said card holder and said cover is pressed to the closed position.

4. A cooking apparatus according to claim 3, wherein two manipulation knobs are provided, one of said knobs being arranged for setting the heating period and the other of said knobs being arranged for setting the heating temperature, each of said knobs being manipulatable when a selected one of said cooking cards is accommodated in said card holder.

* * * * *